United States Patent [19]

Franz

[11] 3,980,226

[45] Sept. 14, 1976

[54] EVACUATEABLE BAG

[76] Inventor: Charles F. Franz, 125 W. Jefferson Ave., Wheaton, Ill. 60187

[22] Filed: May 5, 1975

[21] Appl. No.: 574,602

[52] U.S. Cl. ..... 229/62.5; 53/22 B; 150/8; 206/808; 426/410

[51] Int. Cl.[2] ..... B65D 31/14

[58] Field of Search ..... 229/62.5; 426/129, 112, 426/410, 412, 393; 251/299; 206/808; 53/22 B, 88; 150/9, 8; 5/348 R

[56] References Cited

UNITED STATES PATENTS

| | | | |
|---|---|---|---|
| 2,576,322 | 11/1951 | Waters | 229/62.5 |
| 2,814,382 | 11/1957 | Lossiter | 53/22 B X |
| 2,991,815 | 7/1961 | Pfeiffer | 150/1 |
| 3,253,861 | 5/1966 | Howard | 5/348 R X |
| 3,417,863 | 12/1968 | Paxton | 229/62 X |
| 3,521,806 | 7/1970 | Esty | 229/62.5 X |
| 3,681,092 | 8/1972 | Titchenal et al. | 426/412 |
| 3,815,650 | 6/1974 | Hickey | 150/52 R |

*Primary Examiner*—Stephen P. Garbe
*Attorney, Agent, or Firm*—Olson, Trexler, Wolters, Bushnell & Fosse, Ltd.

[57] ABSTRACT

An evacuateable bag is provided for use as a casing about articles to be stored. The bag is of thin flexible material having one end thereof provided with a large opening through which articles are inserted. After the bag is filled, the large opening is closed and the bag will partially conform to the shape of the article. Oral evacuation means is provided to remove entrapped air from the bag and cause the bag to substantially completely collapse about the article and more closely conform to its shape. After evacuation, seal means is provided on the oral evacuation means to maintain the bag in the evacuated condition.

5 Claims, 6 Drawing Figures

EVACUATEABLE BAG

BACKGROUND OF THE INVENTION

This invention relates generally to thin flexible plastic bags, and more particularly to a plastic bag which can be evacuated after articles are inserted therein.

Heretofore, the evacuation of entrapped air from plastic bags, after articles have been inserted therein, has been accomplished with the use of complex and expensive machinery. For example, plastic bags have been collapsed about articles by inserting a needle-like tube into the bag and connecting the tube to a vacuum pump for evacuating the bag. This type of machinery is common in the packaging of food products such as cheese, meats and vegetables.

The expensive machinery required to evacuate bags heretofore utilized in the packaging of products is not readily available to the individual consumer who, at one time or another, may want to store food products either in a refrigerator or in a freezer by using an evacuated bag.

SUMMARY OF THE INVENTION

Accordingly, it is an object of this invention to provide a simple and efficient means for consumers to package articles in a thin flexible plastic bag which can be orally evacuated in a simple and efficient manner to cause the bag to collapse about the article and conform substantially to its shape.

Another object of this invention is to provide an evacuateable plastic bag which is inexpensive to manufacture while being efficient and reliable in use.

Briefly, the plastic bag construction of this invention is formed of any suitable conventional thin flexible material and is then provided with means for orally withdrawing entrapped air from the bag after it is partially collapsed and closed off at the article receiving end. By so evacuating the bag, deterioration of food products is substantially reduced. Furthermore, evaporation of moisture from food articles into the air space within the bag is substantially reduced and, therefore, food articles will remain fresh for longer periods of time.

Many other objects, features and advantages of this invention will be more fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENT

Figure 1:
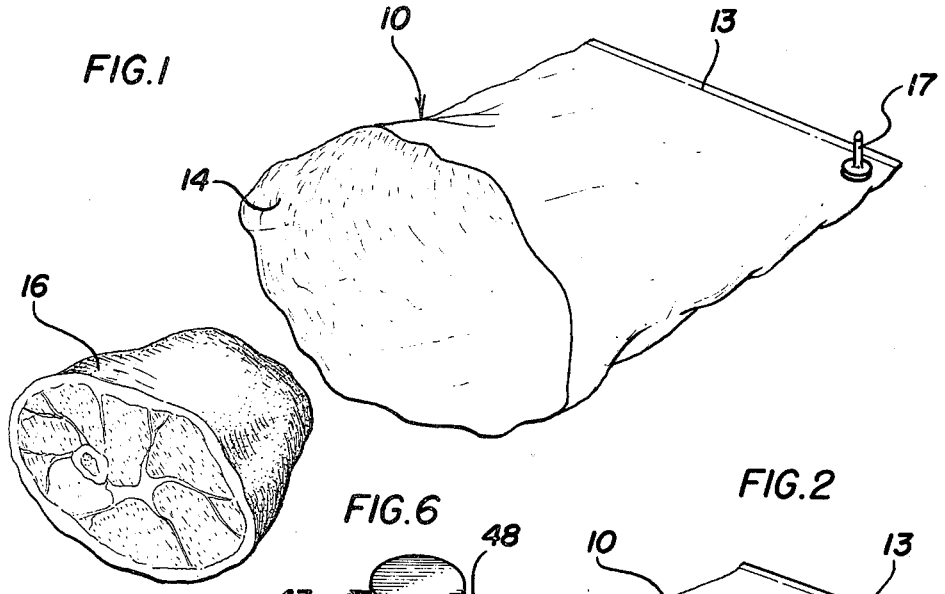
FIG. 1 illustrates a plastic bag constructed in accordance with this invention with the article receiving end thereof opened in readiness to receive a food article.

Referring now to the drawings, there is seen a bag of thin flexible material, preferably plastic, and designated generally by reference numeral 10. The plastic bag 10 can be of any conventional construction and material presently known in the art. For example, the bag may be of the type formed by a continuous plastic tubing closed at the sides and heat-sealed at one end 13 thereof. An article receiving opening 14 is formed at the other end of the bag to receive an article 16 to be wrapped by the bag. Here the article is illustrated as a food product, it being understood that other articles can be encased with the bag of this invention.

Figure 2:
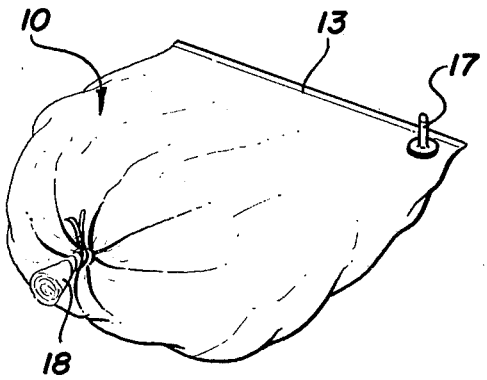
FIG. 2 illustrates the bag of FIG. 1 closed and partially collapsed about the food article.

Most advantageously, an evacuating stem or tube 17 is provided near the closed end of the bag and provides means for substantially completely evacuating entrapped air from the bag to cause the bag to collapse about the article 16 and conform closely to its configuration. For example, after the article 16 is inserted into the bag 10, the article receiving opening is closed and releasably sealed. This is accomplished, for example, by tying a knot in the bag or by tying off the open end of the bag with a wire, tape, string or the like 18, as shown in FIG. 2. The bag therefore partially conforms to the shape of the article, but in many cases there is entrapped air remaining in the bag.

Figure 3:
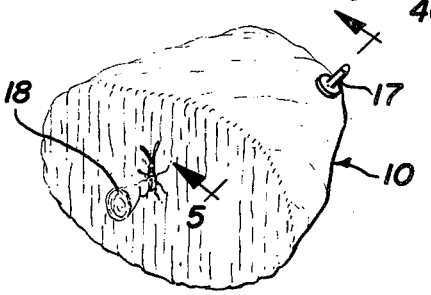
FIG. 3 illustrates the bag after entrapped air is removed therefrom and shows the bag substantially completely collapsed about the article to conform to its shape.

In accordance with this invention entrapped air within the bag 10 is removed by orally withdrawing the air through the tube 17. This will cause the bag 10 to collapse substantially completely about the article and form to its configuration as illustrated in FIG. 3. The tightly collapsed bag forms a casing around the article and improves the storage capabilities for refrigeration and/or freezing and the like.

In one embodiment the evacuating tube 17 has a stem portion 20 extending outwardly from a wall portion 21 of the bag 10. The stem 20 has a passage 23 extending therethrough, a cap or seal means 24 is provided for application to or insertion into the stem to close it off and form an airtight seal therewith. It is to be noted that the bag may be opened and resealed by the means 18 and the sealing cap 24 may also be removed and replaced. This feature enables a user to remove the contents from the bag and then replaces the unused portion of the contents, reseals and re-evacuates the bag.

Figure 5:
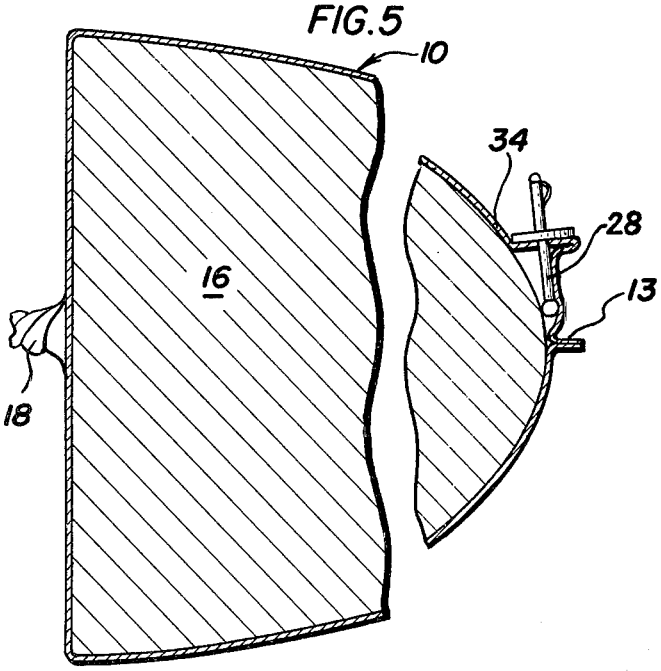
FIG. 5 is a fragmentary sectional view showing the use of the evacuating tube to enable substantially all of the air to be removed from the bag.

Preferably, the stem 20 has an annular flange 26 intermediate the ends thereof and which flange is secured to the wall section 21 by suitable means such as heat sealing or adhesives, or the like. The evacuating device 17 has a second stem portion 28 extending into the bag. The stem portion 28 provides means for preventing the adjacent and opposite wall portions of the bag 10 from collapsing about the passage 23 while the bag is being evacuated. The stem portion 28 has an enlarged terminating end 29 which provides means for maintaining the terminating end opening 30 of the passage 23 clear while evacuating the bag. FIG. 5 illustrates a small air space 34 which may remain about the stem portion 28 within the bag after the bag is substantially completely evacuated. The reduced air space 34 is but a fraction of the amount of air normally entrapped in the bag as a result of closing of the article receiving opening 14 and forming the tie 18 as is common practice.

Figure 4:
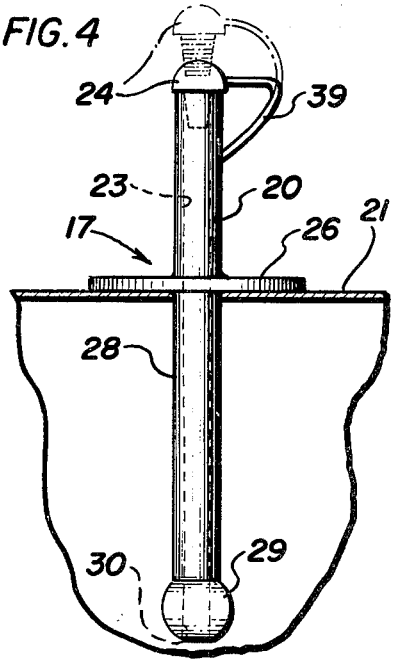
FIG. 4 is an enlarged fragmentary view illustrating the tube used to evacuate the bag of this invention.

As illustrated in FIG. 4, the cap 24 may be secured to the stem 20 by a flexible element or strap 39 which is preferably molded integrally therewith. In the alternative, the cap may be an independent and a separate piece and the retainer portion eliminated.

Figure 6:
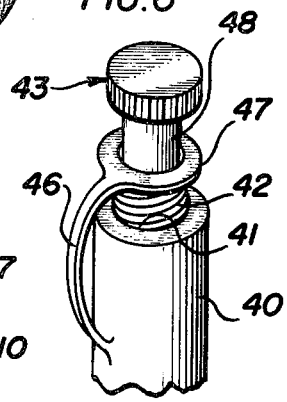
FIG. 6 is a fragmentary partial view showing an alternate form of seal means associated with the terminating end of the tube extending from the bag.

Referring now to FIG. 6, an alternate form of stem construction is illustrated. Here, only the upper fragmentary portion of a stem 40 is shown, but it is understood that the stem includes portions corresponding to elements 26, 28 and 29 described above. The stem 40 is provided with internal threads 41 to receive the threaded end 42 of a cap 43. The cap 43 is held to the stem by a retainer 46 having a ring 47 formed at the end thereof. The ring 47 is urged over the threaded portions 42 and provides a loose rotating fit about a neck portion 48 of the cap 43 which will enable the threaded cap to be screwed into the stem 40.

While several specific embodiments of the present invention have been illustrated herein, it will be understood that still further variations and modifications may be effected without departing from the novel concepts as set forth by the following claims.

The invention is claimed as follows:

1. A casing for the home packaging of articles by a consumer comprising a bag of thin, flexible plastic material, said bag having a predetermined width and including a full width article receiving opening at one end thereof through which articles can be inserted and a sealed opposite end, removably replaceable means for closing and releasably sealing the article receiving opening of the bag, said bag after being sealed being collapsible for substantially conforming to the shape of the article therein, oral evacuation means connected with said bag for enabling a user orally to withdraw air entrapped in said bag and cause said thin, flexible material substantially completely to conform to the shape of the article therein, said oral evacuation means including a short tube extending from said bag at a location toward said opposite end for enabling evacuation of the bag substantially regardless of the extent to which the bag has been filled with an article by a user, and a closure removably replaceably engageable with an end of said tube for sealing the tube.

2. A casing for the packaging of articles as set forth in claim 1, wherein said tube has a portion thereof extending into the interior of said bag.

3. A casing for the packaging of articles as set forth in claim 2 wherein said portion extending into the interior of said bag has an enlarged end.

4. A casing for the packaging of articles as set forth in claim 2 further including a flange formed about the central portion of said tube, said flange being secured to said thin flexible material to form an airtight seal therewith.

5. A casing for the packaging of articles as set forth in claim 4 wherein said flange is secured to the outside of said bag.

* * * * *